US009045709B2

(12) United States Patent
Harle et al.

(10) Patent No.: US 9,045,709 B2
(45) Date of Patent: Jun. 2, 2015

(54) SYNERGISTIC DETERGENT AND ACTIVE METAL COMPOUND COMBINATION

(75) Inventors: Virginie Harle, Senlis (FR); Michael Lallemand, Saint Denis (FR); David Moreton, Belper (GB); Malcolm G J. Macduff, Belper (GB); Magali Pudlarz, Belper (GB)

(73) Assignees: RHODIA OPERATIONS, Aubervilliers (FR); THE LUBRIZOL CORPORATION, Wickliffe, OH (US)

( * ) Notice: Subject to any disclaimer, the term of this patent is extended or adjusted under 35 U.S.C. 154(b) by 473 days.

(21) Appl. No.: 13/380,663

(22) PCT Filed: Jun. 23, 2009

(86) PCT No.: PCT/IB2009/006396

§ 371 (c)(1), (2), (4) Date: Mar. 13, 2012

(87) PCT Pub. No.: WO2010/150040

PCT Pub. Date: Dec. 29, 2010

(65) Prior Publication Data

US 2012/0192823 A1 Aug. 2, 2012

(51) Int. Cl.

| | |
|---|---|
| ***C10L 1/22*** | (2006.01) |
| ***C10L 1/10*** | (2006.01) |
| ***C10L 10/06*** | (2006.01) |
| ***C10L 10/18*** | (2006.01) |
| *C10L 1/12* | (2006.01) |
| *C10L 1/16* | (2006.01) |
| *C10L 1/188* | (2006.01) |
| *C10L 1/198* | (2006.01) |
| *C10L 1/238* | (2006.01) |
| *C10L 1/2383* | (2006.01) |
| *C10L 1/2387* | (2006.01) |

(52) U.S. Cl.

CPC ..... *C10L 1/10* (2013.01); *C10L 1/1233* (2013.01); *C10L 1/1616* (2013.01); *C10L 1/1881* (2013.01); *C10L 1/198* (2013.01); *C10L 1/238* (2013.01); *C10L 1/2383* (2013.01); *C10L 1/2387* (2013.01); *C10L 10/06* (2013.01); *C10L 10/18* (2013.01)

(58) Field of Classification Search

CPC ..... C10L 1/2222; C10L 1/883; C10L 1/232; C10L 1/10; C10L 10/06; C10L 10/18; C10L 1/1233; C10L 1/238; C10L 1/2383; C10L 1/2387

USPC ..... 44/422

See application file for complete search history.

(56) References Cited

U.S. PATENT DOCUMENTS

| | | | | |
|---|---|---|---|---|
| 3,778,371 | A | 12/1973 | Malec | |
| 8,460,404 | B2 * | 6/2013 | Hollingshurst | 44/422 |
| 2005/0039382 | A1 | 2/2005 | Blanchard et al. | |

FOREIGN PATENT DOCUMENTS

| | | | |
|---|---|---|---|
| EP | 1 344 809 | A1 | 9/2003 |
| EP | 1 512 736 | A1 | 3/2005 |
| EP | 1 884 556 | A2 | 2/2008 |
| EP | 1 905 813 | A2 | 4/2008 |
| WO | WO 2005/097952 | A1 | 10/2005 |
| WO | WO 2006/063161 | A2 | 6/2006 |
| WO | WO 2006/135881 | A2 | 12/2006 |
| WO | WO 2006/138269 | A2 | 12/2006 |
| WO | WO 2007/120262 | A2 | 10/2007 |
| WO | WO 2008/027881 | A2 | 3/2008 |
| WO | WO 2008/107364 | A1 | 9/2008 |

OTHER PUBLICATIONS

International Search Report (PCT/ISA/210) issued on Apr. 1, 2010, by the International Patent Institute as the International Searching Authority for International Application No. PCT/IB2009/006396.

* cited by examiner

*Primary Examiner* — Cephia D Toomer

(74) *Attorney, Agent, or Firm* — Dentons US LLP

(57) ABSTRACT

Compositions that include a detergent composition and an active metal compound are described wherein the detergent composition includes a quaternary ammonium salt detergent and optionally an oxygen-containing detergent, and wherein the active metal compound is in the form of a colloidal dispersion, comprising an organic phase, particles of an iron compound in its amorphous form, and at least one amphiphilic agent. These compositions can be used in fuels to provide improved engine performance by, for example, reducing fuel injector fouling in the engine and/or by improving the regeneration of the engine's particulate exhaust trap.

16 Claims, No Drawings

SYNERGISTIC DETERGENT AND ACTIVE METAL COMPOUND COMBINATION

This application is the United States national phase of PCT/IB2009/006396, filed Jun. 23, 2009, and designating the United States (published in the English language on Dec. 29, 2010, as WO 2010/150040 A1; the title and abstract were also published in English), each hereby expressly incorporated by reference in its entirety and each assigned to the assignee hereof.

BACKGROUND OF THE INVENTION

The compositions of the present invention relate to a detergent composition comprising a quaternary ammonium salt detergent and optionally an oxygen-containing detergent in combination with an active metal containing compound, such as a fuel catalyst and/or an exhaust trap additive. These compositions may be used in fuels and provide improved engine performance when such fuels are used, specifically by reducing fuel injector fouling in the engine and/or by improving the regeneration of the particulate exhaust trap.

It is well known that deposits can form in the injectors of diesel engines during use. The amount of deposits and rate of formation depend on the fuel being used in the engine as well as the additives present in that fuel. Fuels which contain unstable components, such as fatty acid methyl esters (FAME), tend to form more deposits than mineral-based fuels that do not contain such components.

In addition, the presence of metals in fuels, such as metal-containing fuel catalyst, can lead to higher levels of deposits and so higher levels of injector fouling.

Metals may be introduced into fuels from various sources including contact with metal components in the fuel distribution system, contamination, and by other means. One example of the presence of a metal in a fuel is through the deliberate addition to the fuel of a metal catalyst. Such catalysts can aid in Diesel Particulate Filter (DPF) regeneration and so are desirable, although the deposits they may promote are not. DPFs are often used on the exhausts of diesel vehicles to filter out soot from the exhaust gas. The filter quickly becomes filled with soot, and requires regular cleaning. This is done by raising the exhaust temperature to cause the soot on the filter to burn off. This process is facilitated by adding a metal catalyst to the diesel fuel. The catalyst becomes incorporated in the soot, and allows the soot to be burnt at lower temperatures. The kinetics of the combustion is also improved. A preferred method of delivering such catalysts is by continuously dosing a metal-containing additive into the fuel from an on-board container. The additive then passes through the engine and into the exhaust system where it comes into contact with the DPF and the soot on the DPF. Unfortunately, such metal-containing additives can promote engine deposit formation, leading to higher levels of injector fouling in the engine.

Deposits can lead to loss of engine performance and eventually, to possible damage of the engine. It is known that detergent additives can be used to reduce or eliminate deposit formation in injectors. However, particularly in the case of fuel-borne DPF catalysts, there is continued need for providing compositions that allow for use of effective DPF catalysts and other metal-containing additives while controlling injector fouling and other engine deposit-related problems, while doing so with the least amount of additive, and so the least cost, possible.

Among the fuel-borne catalysts (FBC), dispersions of rare earth or iron compositions are known as efficient additives for the DPF regeneration. These colloidal dispersions must have good dispersibility in the medium into which they are introduced, high stability over time and sufficient catalytic activity. Known colloidal dispersions do not always satisfy all of those criteria. They may, for example, have good dispersibility but not sufficient stability especially in some types of fuel such as biofuels. Furthermore, as mentioned above, the dispersions must lead to a limited injector fouling. More-over, the presence of a fuel-borne catalyst in the fuel may decrease the oxidation resistance of said fuel, more particularly in the case of biofuels.

There is a need for providing compositions comprising a dispersion of active additives for the DPF regeneration with good stability, limited injector fouling or which induces a limited decrease of the oxidation resistance of the fuel.

SUMMARY OF THE INVENTION

The present invention provides a composition comprising (A) a detergent composition that contains (1) a quaternary ammonium salt detergent and (B) an active metal containing compound which is in the form of a colloidal dispersion. The colloidal dispersion contains an organic phase, particles of an iron compound in its amorphous form, and at least one amphiphilic agent.

In some embodiments the detergent compositions of the present invention further include (2) an oxygen-containing detergent.

The present invention also provides a method of operating an internal combustion engine by supplying to the engine a composition containing the combination of (A) detergent and (B) colloidal dispersion described above with the engine's fuel.

The present invention further provides a fuel composition containing a fuel and a composition containing the said combination.

DETAILED DESCRIPTION OF THE INVENTION

Various features and embodiments of the invention will be described below by way of non-limiting illustration.

The Quaternary Ammonium Salt Detergent

The compositions of the present invention comprise a quaternary ammonium salt. The quaternary ammonium salt may be the reaction product of: (i) at least one compound which may include: (a) the condensation product of a hydrocarbyl-substituted acylating agent and a compound having an oxygen or nitrogen atom capable of condensing the acylating agent where the condensation product has at least one tertiary amino group; (b) a polyalkene-substituted amine having at least one tertiary amino group; and (c) a Mannich reaction product having at least one tertiary amino group, where the Mannich reaction product is derived from a hydrocarbyl-substituted phenol, an aldehyde, and an amine; and (ii) a quaternizing agent suitable for converting the tertiary amino group of compound (i) to a quaternary nitrogen. The quaternizing agent may include dialkyl sulfates, benzyl halides, hydrocarbyl substituted carbonates; hydrocarbyl epoxides in combination with an acid or mixtures thereof.

The compounds of component (i)(a), (i)(b) and (i)(c), described in greater detail below, contain at least one tertiary amino group and include compounds that may be alkylated to contain at least one tertiary amino group after an alkylation step.

Examples of quaternary ammonium salt and methods for preparing the same are described in U.S. Pat. Nos. 4,253,980; 3,778,371; 4,171,959; 4,326,973; 4,338,206; and 5,254,138.

The quaternary ammonium salts may be prepared in the presence of a solvent, which may or may not be removed once the reaction is complete. Suitable solvents include, but are not limited to, diluent oil, petroleum naphtha, and certain alcohols. In one embodiment, these alcohols contain at least 2 carbon atoms, and in other embodiments at least 4, at least 6 or at least 8 carbon atoms. In another embodiment, the solvent of the present invention contains 2 to 20 carbon atoms, 4 to 16 carbon atoms, 6 to 12 carbon atoms, 8 to 10 carbon atoms, or just 8 carbon atoms. These alcohols normally have a 2-($C_{1-4}$ alkyl) substituent, namely, methyl, ethyl, or any isomer of propyl or butyl. Examples of suitable alcohols include 2-methylheptanol, 2-methyldecanol, 2-ethylpentanol, 2-ethylhexanol, 2-ethylnonanol, 2-propylheptanol, 2-butylheptanol, 2-butyloctanol, isooctanol, dodecanol, cyclohexanol, methanol, ethanol, propan-1-ol, 2-methylpropan-2-ol, 2-methylpropan-1-ol, butan-1-ol, butan-2-ol, pentanol and its isomers, and mixtures thereof. In one embodiment the solvent of the present invention is 2-ethylhexanol, 2-ethyl nonanol, 2-methylheptanol, or combinations thereof. In one embodiment the solvent of the present invention includes 2-ethylhexanol.

Succinimide Quaternary Ammonium Salts

In one embodiment the quaternary salt detergent comprises the reaction product of (i)(a) the condensation product of a hydrocarbyl-substituted acylating agent and a compound having an oxygen or nitrogen atom capable of condensing with said acylating agent where the condensation product has at least one tertiary amino group; and (ii) a quaternizing agent suitable for converting the tertiary amino group of compound (i) to a quaternary nitrogen.

Hydrocarbyl substituted acylating agents useful in the present invention include the reaction product of a long chain hydrocarbon, generally a polyolefin, with a monounsaturated carboxylic acid or derivative thereof.

Suitable monounsaturated carboxylic acids or derivatives thereof include: (i) □.□-monounsaturated $C_4$ to $C_{10}$ dicarboxylic acids, such as fumaric acid, itaconic acid, maleic acid; (ii) derivatives of (i), such as anhydrides or $C_1$ to $C_5$ alcohol derived mono- or di-esters of (i); (iii) □.□-monounsaturated $C_3$ to $C_{10}$ monocarboxylic acids, such as acrylic acid and methacrylic acid; or (iv) derivatives of (iii), such as $C_1$ to $C_5$ alcohol derived esters of (iii).

Suitable long chain hydrocarbons for use in preparing the hydrocarbyl substituted acylating agents include any compound containing an olefinic bond represented by the general Formula I, shown here:

$$(R^1)(R^2)C{=}C(R^3)(CH(R^4)(R^5)) \quad (I)$$

wherein each of $R^1$, $R^2$, $R^3$, $R^4$ and $R^5$ is, independently, hydrogen or a hydrocarbon based group. In some embodiments at least one of $R^3$, $R^4$ or $R^5$ is a hydrocarbon based group containing at least 20 carbon atoms.

These long chain hydrocarbons, which may also be described as polyolefins or olefin polymers, are reacted with the monounsaturated carboxylic acids and derivatives described above to form the hydrocarbyl substituted acylating agents used to prepare the nitrogen-containing detergent of the present invention. Suitable olefin polymers include polymers comprising a major molar amount of $C_2$ to $C_{20}$, or $C_2$ to $C_5$ mono-olefins. Such olefins include ethylene, propylene, butylene, isobutylene, pentene, octene-1, or styrene. The polymers may be homo-polymers, such as polyisobutylene, as well as copolymers of two or more of such olefins. Suitable copolymers include copolymers of ethylene and propylene, butylene and isobutylene, and propylene and isobutylene. Other suitable copolymers include those in which a minor molar amount of the copolymer monomers, e.g. 1 to 10 mole %, is a $C_4$ to $C_{18}$ di-olefin. Such copolymers include: a copolymer of isobutylene and butadiene; and a copolymer of ethylene, propylene and 1,4-hexadiene.

In one embodiment, at least one of the —R groups of Formula (I) shown above is derived from polybutene, that is, polymers of $C_4$ olefins, including 1-butene, 2-butene and isobutylene. $C_4$ polymers include polyisobutylene. In another embodiment, at least one of the —R groups of Formula I is derived from ethylene-alpha olefin polymers, including ethylenepropylene-diene polymers. Examples of documents that described ethylene-alpha olefin copolymers and ethylene-lower olefin-diene ter-polymers include U.S. Pat. Nos. 3,598,738; 4,026,809; 4,032,700; 4,137,185; 4,156,061; 4,320,019; 4,357,250; 4,658,078; 4,668,834; 4,937,299; and 5,324,800.

In another embodiment, the olefinic bonds of Formula (I) are predominantly vinylidene groups, represented by the following formula:

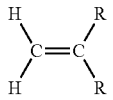

(II)

wherein each R is a hydrocarbyl group; which in some embodiments may be:

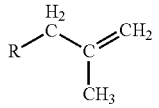

(III)

wherein R is a hydrocarbyl group.

In one embodiment, the vinylidene content of Formula (I) may comprise at least 30 mole % vinylidene groups, at least 50 mole % vinylidene groups, or at least 70 mole % vinylidene groups. Such materials and methods of preparation are described in U.S. Pat. Nos. 5,071,919; 5,137,978; 5,137,980; 5,286,823, 5,408,018, 6,562,913, 6,683,138, 7,037,999; and United States publications: 2004/0176552A1; 2005/0137363; and 2006/0079652A1. Such products are commercially available from BASF, under the tradename GLISSOPAL™ and from Texas PetroChemical LP, under the tradename TPC 1105™ and TPC 595™.

Methods of making hydrocarbyl substituted acylating agents from the reaction of monounsaturated carboxylic acid reactants and compounds of Formula (I) are well know in the art and disclosed in: U.S. Pat. Nos. 3,361,673; 3,401,118; 3,087,436; 3,172,892; 3,272,746, 3,215,707; 3,231,587; 3,912,764; 4,110,349; 4,234,435; 6,077,909; and 6,165,235.

In another embodiment, the hydrocarbyl substituted acylating agent can be made from the reaction of a compound represented by Formula (I) with at least one carboxylic reactant represented by the following formulas:

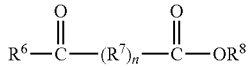

(IV)

and

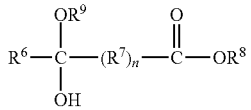

(V)

wherein each of $R^6$, $R^8$ and $R^9$ is independently H or a hydrocarbyl group, $R^7$ is a divalent hydrocarbylene group, and n is 0 or 1. Such compounds and the processes for making them are disclosed in U.S. Pat. Nos. 5,739,356; 5,777,142; 5,786,490; 5,856,524; 6,020,500; and 6,114,547.

In yet another embodiment, the hydrocarbyl substituted acylating agent may be made from the reaction of any compound represented by Formula (I) with any compound represented by Formula (IV) or Formula (V), where the reaction is carried out in the presence of at least one aldehyde or ketone. Suitable aldehydes include formaldehyde, acetaldehyde, propionaldehyde, butyraldehyde, isobutyraldehyde, pentanal, hexanal. heptaldehyde, octanal, benzaldehyde, as well as higher aldehydes. Other aldehydes, such as dialdehydes, especially glyoxal, are useful, although monoaldehydes are generally preferred. In one embodiment, the aldehyde is formaldehyde, which may be supplied in the aqueous solution often referred to as formalin, but which is more often used in the polymeric form referred to as paraformaldehyde. Paraformaldehyde is considered a reactive equivalent of and/or source of formaldehyde. Other reactive equivalents include hydrates or cyclic trimers. Suitable ketones include acetone, butanone, methyl ethyl ketone, as well as other ketones. In some embodiments, one of the two hydrocarbyl groups of the ketone is a methyl group. Mixtures of two or more aldehydes and/or ketones are also useful. Such hydrocarbyl substituted acylating agents and the processes for making them are disclosed in U.S. Pat. Nos. 5,840,920; 6,147,036; and 6,207,839.

In another embodiment, the hydrocarbyl substituted acylating agent may include methylene bis-phenol alkanoic acid compounds. Such compounds may be the condensation product of (i) an aromatic compound of the formula:

$$R_m—Ar—Z_c \quad (VI)$$

and (ii) at least on carboxylic reactant such as the compounds of formula (IV) and (V) described above, wherein, in Formula (VI): each R is independently a hydrocarbyl group; m is 0 or an integer from 1 up to 6 with the proviso that m does not exceed the number of valences of the corresponding Ar group available for substitution; Ar is an aromatic group or moeity containing from 5 to 30 carbon atoms and from 0 to 3 optional substituents such as amino, hydroxy- or alkyl-polyoxyalkyl, nitro, aminoalkyl, and carboxy groups, or combinations of two or more of said optional substituents; Z is independently —OH, —O, a lower alkoxy group, or $—(OR^{10})_bOR^{11}$ wherein each $R^{10}$ is independently a divalent hydrocarbyl group, b is a number from 1 to 30, and $R^{11}$ is —H or a hydrocarbyl group; and c is a number ranging from 1 to 3.

In one embodiment, at least one hydrocarbyl group on the aromatic moiety is derived from polybutene. In one embodiment, the source of the hydrocarbyl groups described above are polybutenes obtained by polymerization of isobutylene in the presence of a Lewis acid catalyst such as aluminum trichloride or boron trifluoride.

Such compounds and the processes for making them are disclosed in U.S. Pat. Nos. 3,954,808; 5,336,278; 5,458,793; 5,620,949; 5,827,805; and 6,001,781.

In another embodiment, the reaction of (i) with (ii), optionally in the presence of an acidic catalyst such as organic sulfonic acids, heteropolyacids, and mineral acids, can be carried out in the presence of at least one aldehyde or ketone. The aldehyde or ketone reactant employed in this embodiment is the same as those described above. Such compounds and the processes for making them are disclosed in U.S. Pat. No. 5,620,949.

Still other methods of making suitable hydrocarbyl substituted acylating agents can be found in U.S. Pat. Nos. 5,912,213; 5,851,966; and 5,885,944.

The succinimide quaternary ammonium salt detergents are derived by reacting the hydrocarbyl substituted acylating agent described above with a compound having an oxygen or nitrogen atom capable of condensing with the acylating agent. In one embodiment, suitable compounds contain at least one tertiary amino group.

In one embodiment, this compound may be represented by one of the following formulas:

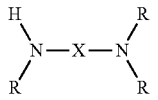

(VII)

and

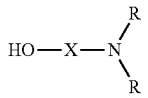

(VIII)

Wherein, for both Formulas (VII) and (VIII), each X is independently a alkylene group containing 1 to 4 carbon atoms; and each R is independently a hydrocarbyl group.

Suitable compounds include but are not limited to: 1-aminopiperidine, 1-(2-aminoethyl)piperidine, 1-(3-aminopropyl)-2-pipecoline, 1-methyl-(4-methylamino)piperidine, 1-amino-2,6-dimethylpiperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), or combinations thereof. In some embodiments the amine used is 3-dimethylaminopropylamine, 3-diethylamino-propylamine, 1-(2-aminoethyl)pyrrolidine, N,N-dimethylethylenediamine, or combinations thereof.

Suitable compounds further include aminoalkyl substituted heterocyclic compounds such as 1-(3-aminopropyl)imidazole and 4-(3-aminopropyl)morpholine, 1-(2-aminoethyl) piperidine, 3,3-diamino-N-methyldipropylamine, 3'3-aminobis(N,N-dimethylpropylamine) These have been mentioned in previous list.

Still further nitrogen or oxygen containing compounds capable of condensing with the acylating agent which also have a tertiary amino group include: alkanolamines, including but not limited to triethanolamine, trimethanolamine, N,N-dimethylaminopropanol, N,N-diethylaminopropanol, N,N-diethylaminobutanol, N,N,N-tris(hydroxyethyl)amine, and N,N,N-tris(hydroxymethyl)amine.

The succinimide quaternary ammonium salt detergents of the present invention are formed by combining the reaction product described above (the reaction product of a hydrocarbyl-substituted acylating agent and a compound having an oxygen or nitrogen atom capable of condensing with said acylating agent and further having at least one tertiary amino group) with a quaternizing agent suitable for converting the tertiary amino group to a quaternary nitrogen. Suitable quaternizing agents are discussed in greater detail below. In some embodiments these preparations may be carried out neat or in the presence of a solvent, as described above. By way of non-limiting example, preparations of succinimide quaternary ammonium salts are provided below.

EXAMPLE Q-1

Polyisobutylene succinic anhydride (100 pbw), which itself is prepared by reacting 1000 number average molecular weight high vinylidene polyisobutylene and maleic anhydride, is heated to 80° C. and is charged to a jacketed reaction vessel fitted with stirrer, condenser, feed pump attached to subline addition pipe, nitrogen line and thermocouple/temperature controller system. The reaction vessel is heated to 100° C. Dimethylaminopropylamine (10.9 pbw) is charged to the reaction, maintaining the batch temperature below 120° C., over an 8 hour period. The reaction mixture is then heated to 150° C. and maintained at temperature for 4 hours, resulting in a non-quaternized succinimide detergent.

A portion of the non-quaternized succinimide detergent (100 pbw) is then charged to a similar reaction vessel. Acetic acid (5.8 pbw) and 2-ethylhexanol (38.4 pbw) are added to the vessel and the mixture is stirred and heated to 75° C. Propylene oxide (8.5 pbw) is added to the reaction vessel over 4 hours, holding the reaction temperature at 75° C. The batch is held at temperature for 4 hours. The resulting product contains a quaternized succinimide detergent.

EXAMPLE Q-2

A non-quaternized succinimide detergent is prepared from a mixture of polyisobutylene succinic anhydride, as described above, (100 pbw) and diluent oil—pilot 900 (17.6 pbw) which are heated with stirring to 110° C. under a nitrogen atmosphere. Dimethylaminopropylamine (DMAPA, 10.8 pbw) is added slowly over 45 minutes maintaining batch temperature below 115° C. The reaction temperature is increased to 150° C. and held for a further 3 hours. The resulting compound is a DMAPA succinimide non-quaternized detergent. A portion of this non-quaternized succinimide detergent (100 pbw) is heated with stirring to 90° C. Dimethylsulphate (6.8 pbw) is charged to the reaction vessel and stirring is resumed at 300 rpm under a nitrogen blanket. The resulting exotherm raises the batch temperature to ~100° C. The reaction is maintained at 100° C. for 3 hours before cooling back and decanting. The resulting product contains a dimethylsulphate quaternary ammonium salt.

Polyalkene-Substituted Amine Quaternary Ammonium Salts

In one embodiment the quaternary ammonium salt is the reaction product of: (i)(b) a polyalkene-substituted amine having at least one tertiary amino group; and (ii) a quaternizing agent suitable for converting the tertiary amino group of compound (i) to a quaternary nitrogen.

Suitable polyalkene-substituted amines may be derived from an olefin polymer and an amine, such as ammonia, monoamines, polyamines or mixtures thereof. They may be prepared by a variety of methods. Suitable polyalkene-substituted amines or the amines from which they are derived either contain a tertiary amino group or may be alkylated until they contain a tertiary amino group, so long as the polyalkene-substituted amine has at least one tertiary amino group when it is reacted with the quaternizing agent.

One method of preparation of a polyalkene-substituted amine involves reacting a halogenated olefin polymer with an amine, as disclosed in U.S. Pat. Nos. 3,275,554; 3,438,757; 3,454,555; 3,565,804; 3,755,433; and 3,822,289.

Another method of preparation of a polyalkene-substituted amine involves reaction of a hydro-formylated olefin with a polyamine and hydrogenating the reaction product, as disclosed in U.S. Pat. Nos. 5,567,845 and 5,496,383.

Another method for preparing a polyalkene-substituted amine involves converting a polyalkene, by means of a conventional epoxidation reagent, with or without a catalyst, into the corresponding epoxide and converting the epoxide into the polyalkene substituted amine by reaction with ammonia or an amine under the conditions of reductive amination, as disclosed in U.S. Pat. No. 5,350,429.

Another method for preparing a polyalkene-substituted amine involves hydrogenation of a β-aminonitrile, made by reacting an amine with a nitrile, as disclosed in U.S. Pat. No. 5,492,641.

Yet another method for preparing a polyalkene-substituted amine involves hydroformylating polybutene or polyisobutylene, with a catalyst, such as rhodium or cobalt, in the presence of CO, $H_2$ and $NH_3$ at elevated pressures and temperatures, as disclosed in U.S. Pat. Nos. 4,832,702; 5,496,383 and 5,567,845.

The above methods for the preparation of polyalkene substituted amine are for illustrative purposes only and are not meant to be an exhaustive list. The polyalkene-substituted amines of the present invention are not limited in scope to the methods of their preparation disclosed hereinabove.

The polyalkene-substituted amine may be derived from olefin polymers. Suitable olefin polymers for preparing the polyalkene-substituted amines of the invention are the same as those described above.

The polyalkene-substituted amine may be derived from ammonia, monoamines, polyamines, or mixtures thereof, including mixtures of different monoamines, mixtures of different polyamines, and mixtures of monomamines and polyamines (which include diamines). Suitable amines include aliphatic, aromatic, heterocyclic and carbocyclic amines.

In one embodiment, the amines may be characterized by the formula:

$$R^{12}R^{13}NH \qquad \text{(IX)}$$

wherein $R^{12}$ and $R^{13}$ are each independently hydrogen, hydrocarbon, amino-substituted hydrocarbon, hydroxy-substituted hydrocarbon, alkoxy-substituted hydrocarbon, or acylimidoyl groups provided that no more than one of $R^{12}$ and $R^{13}$ is hydrogen. The amine may be characterized by the presence of at least of at least one primary ($H_2N$—) or secondary amino (H—N<) group. These amines, or the polyalkene-substituted amines they are used to prepare may be alkylated as needed to ensure they contain at least one tertiary amino group. Examples of suitable monoamines include ethylamine, dimethylamine, diethylamine, n-butylamine, dibutylamine, allylamine, isobutylamine, cocoamine, stearylamine, laurylamine, methyllaurylamine, oleylamine, N-methyl-octylamine, dodecylamine, diethanolamine, morpholine, and octadecylamine.

The polyamines from which the detergent is derived include principally alkylene amines conforming, for the most part, to the formula:

$$\underset{\underset{R^{14}}{|}}{HN}\text{-(Alkylene-}\underset{\underset{R^{14}}{|}}{N})_n\text{—}R^{14} \qquad \text{(X)}$$

wherein n is an integer typically less than 10, each $R^{14}$ is independently hydrogen or a hydrocarbyl group typically having up to 30 carbon atoms, and the alkylene group is typically an alkylene group having less than 8 carbon atoms. The alkylene amines include principally, ethylene amines, hexylene amines, heptylene amines, octylene amines, other polymethylene amines. They are exemplified specifically by: ethylenediamine, diethylenetriamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine, aminopropylmorpholine and dimethylaminopropylamine. Higher homologues such as are obtained by condensing two or more of the above-illustrated alkylene amines likewise are useful. Tetraethylene pentamine is particularly useful.

The ethylene amines, also referred to as polyethylene polyamines, are especially useful. They are described in some detail under the heading "Ethylene Amines" in Encyclopedia of Chemical Technology, Kirk and Othmer, Vol. 5, pp. 898-905, Interscience Publishers, New York (1950).

Any of the above polyalkene-substituted amines, or the amines from which they are derived, which are secondary or primary amines, may be alkylated to tertiary amines using alkylating agents before they are reacted with the quaternizing agents to form the quaternary ammonium salt additives of the present invention. Suitable alkylating agents include the quaternizing agents discussed below.

The polyalkene-substituted amine quaternary ammonium salts_of the present invention are formed by combining the reaction product described above (the polyalkene-substituted amine, having at least one tertiary amino group) with a quaternizing agent suitable for converting the tertiary amino group to a quaternary nitrogen. Suitable quaternizing agents are discussed in greater detail below. By way of non-limiting example, a preparation of a polyalkene-substituted amine quaternary ammonium salt is provided below.

EXAMPLE Q-3

An apparatus suitable to handle chlorine and hydrogen chloride gas (glass reactor, glass stirrer, PTFE joints, glass thermowell for thermocouple) is connected to sodium hydroxide scrubbers. The glass vessel is charged with low vinylidene 1000 Mn polyisobutylene (PIB, 100 grams) and is heated to 110-120° C. Chlorine (70 grams) is bubbled into the reactor over 7 hours. The reaction mixture is then sparged with nitrogen at 110-120° C. overnight to remove HCl.

The resultant PIB chloride is transferred to an autoclave and the autoclave is sealed. For every mole (~1030 g) of PIB chloride, 1 mole of gaseous dimethylamine (DMA, 45 g) is added and the reaction is heated to 160-170° C. and held for 8 hours, or until no further reduction in pressure is seen. The reaction is cooled to room temperature and the pressure is released. Enough Solvesso™ 150 solvent is added to make a 70% w/w actives solution and the reaction is stirred until homogenous. The resultant polyisobutene-dimethylamine (PIB-DMA) solution is transferred to a separating funnel and washed twice with 2M sodium hydroxide solution, to remove HCl and NaCl. After separation, the product is dried over MgSO4 and is filtered through a Celite™ pad.

The resultant PIB-DMA solution (41 grams of the 70% active solution) is charged to a glass reaction vessel and stirred at room temperature. Dimethyl sulphate (3.3 grams) is added dropwise over one minute to provide the quaternary ammonium salt. The mixture is stirred at room temperature for 1 hour under a nitrogen blanket and is sampled and titrated against bromocresol green indicator. The resulting compound is a quaternary ammonium salt detergent of a polyalkene-substituted amine.

Mannich Quaternary Ammonium Salts

In one embodiment the quaternary ammonium salt is the reaction product of: (i)(c) a Mannich reaction product; and (ii) a quaternizing agent suitable for converting the tertiary amino group of compound (i) to a quaternary nitrogen. Suitable Mannich reaction products have at least one tertiary amino group and are prepared from the reaction of a hydrocarbyl-substituted phenol, an aldehyde, and an amine.

The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available. Suitable polyolefins include those described in the sections above. The hydrocarbyl-substituted phenol can be prepared by alkylating phenol with one of these suitable olefins or polyolefins, such as a polyisobutylene or polypropylene, using well-known alkylation methods.

The aldehyde used to form the Mannich detergent can have 1 to 10 carbon atoms, and is generally formaldehyde or a reactive equivalent thereof, such as formalin or paraformaldehyde.

The amine used to form the Mannich detergent can be a monoamine or a polyamine. Amines suitable for preparing the Mannich reaction product of the invention are the same as those are described in the sections above.

In one embodiment, the Mannich detergent is prepared by reacting a hydrocarbyl-substituted phenol, an aldehyde, and an amine, as described in U.S. Pat. No. 5,697,988. In one embodiment, the Mannich reaction product is prepared from: an alkylphenol derived from a polyisobutylene; formaldehyde; and a primary monoamine, secondary monoamine, or alkylenediamine. In some of such embodiments the amine is ethylenediamine or dimethylamine. Other methods of preparing suitable Mannich reaction products can be found in U.S. Pat. Nos. 5,876,468 and 5,876,468.

As discussed above, it may be necessary, with some of the amines, to further react the Mannich reaction product with an epoxide or carbonate, or other alkylating agent, in order to obtain the tertiary amino group.

The Mannich quaternary ammonium salts of the present invention are formed by combining the reaction product described above (the Mannich reaction product having at least on tertiary amino group) with a quaternizing agent suitable for converting the tertiary amino group to a quaternary nitrogen. Suitable quaternizing agents are discussed in greater detail below. By way of non-limiting example, a preparation of a Mannich quaternary ammonium salt is provided below.

EXAMPLE Q-4

Alkylated phenol (800 grams), which itself is prepared from 1000 Mn polyisobutylene, and SO-44 diluent oil (240 grams) is charged to a reaction vessel matching the description above. A nitrogen blanket is applied to the vessel and the mixture is stirred at 100 rpm. To this mixture, Formalin (55.9 grams) is added (dropwise) over 50 minutes. After which, dimethylamine (DMA, 73.3 grams) is added (dropwise) over the next 50 minutes. The mixture is heated to 68° C. and held for one hour. The mixture is then heated to 106° C. and held for a further 2 hours. The temperature of the mixture is then increased to 130° C. and held for 30 minutes before allowing the mixture to cool to ambient temperature. The mixture is purified by vacuum distillation (at 130° C. and −0.9 bar) to remove any remaining water, resulting in a DMA Mannich.

The DMA Mannich (1700 grams) is added to a reaction vessel. Styrene oxide (263 grams), acetic acid (66 grams) and methanol (4564 grams) are added to the vessel and the mixture is heated with stirring to reflux (~75° C.) for 6.5 hours under a nitrogen blanket. The reaction is purified by vacuum distillation (at 30° C. and −0.8 bar). The resulting compound is a Mannich quaternary ammonium salt detergent.

The Quaternizing Agent

Suitable quaternizing agents for preparing any of the quaternary ammonium salt detergents described above include dialkyl sulfates, benzyl halides, hydrocarbyl substituted carbonates, hydrocarbyl epoxides used in combination with an acid, or mixtures thereof.

In one embodiment the quaternizing agent includes: halides such as chloride, iodide or bromide; hydroxides; sulphonates; alkyl sulphates such as dimethyl sulphate; sultones; phosphates; $C_{1-12}$ alkylphosphates; di-$C_{1-12}$ alkylphosphates; borates; $C_{1-12}$ alkylborates; nitrites; nitrates; carbonates; bicarbonates; alkanoates; O,O-di-$C_{1-12}$ alkyldithiophosphates; or mixtures thereof.

In one embodiment the quaternizing agent may be: a dialkyl sulphate such as dimethyl sulphate; N-oxides; sultones such as propane or butane sultone; alkyl, acyl or aralkyl halides such as methyl and ethyl chloride, bromide or iodide or benzyl chloride; hydrocarbyl (or alkyl) substituted carbonates; or combinations thereof. If the aralkyl halide is benzyl chloride, the aromatic ring is optionally further substituted with alkyl or alkenyl groups.

The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxides, as represented by the following formula:

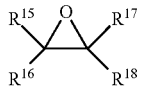

(XI)

wherein $R^{15}$, $R^{16}$, $R^{17}$ and $R^{18}$ can be independently H or a $C_{1-50}$ hydrocarbyl group. Examples of suitable hydrocarbyl epoxides include: styrene oxide, ethylene oxide, propylene oxide, butylene oxide, stilbene oxide, $C_{2-50}$ epoxides, or combinations thereof.

Any of the quaternizing agents described above, including the hydrocarbyl epoxides, may be used in combination with an acid. Suitable acids include carboxylic acids, such as acetic acid, propionic acid, butyric acid, and the like.

The Oxygen-Containing Detergent

In some embodiments the detergent compositions of the present invention comprises an oxygen-containing detergent. The oxygen-containing detergent may comprise a hydrocarbon substituted with at least two carboxy functionalities in the form of acids or at least one carboxy functionality in the form an anhydride. In some embodiments the additive is a hydrocarbon substituted with at least two carboxy functionalities in the form of acids or anhydrides. In other embodiments the additive is a hydrocarbyl-substituted succinic acylating agent. In other embodiments the substituted hydrocarbon additive is a dimer acid compound. In still other embodiments the substituted hydrocarbon additive of the present invention includes a combination of two or more of the additives described in this section.

Suitable substituted hydrocarbon additives include dimer acids. Dimer acids are a type of di-acid polymer derived from fatty acids and/or polyolefins, including the ployalkenes described herein, which contain acid functionality. In some embodiments, the dimer acid used in the present invention is derived from $C_{10}$ to $C_{20}$, $C_{12}$ to $C_{18}$, and/or $C_{16}$ to $C_{18}$ polyolefins.

These substituted hydrocarbon additives include succinic acids, halides, anhydrides and combination thereof. In some embodiments the agents are acids or anhydrides, and in other embodiments the agents are anhydrides, and in still other embodiments the agents are hydrolyzed anhydrides. The hydrocarbon of the substituted hydrocarbon additive and/or the primary hydrocarbyl group of the hydrocarbyl-substituted succinic acylating agent generally contains an average of at least 8, or 30, or 35 up to 350, or to 200, or to 100 carbon atoms. In one embodiment, the hydrocarbyl group is derived from a polyalkene.

Suitable polyalkenes include homopolymers and interpolymers of polymerizable olefin monomers of 2 to 16 or to 6, or to 4 carbon atoms. Suitable olefins and polyolefins include any of those described in the sections above. In some embodiments the olefin is a monoolefin such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a polymer is a polybutene. In one instance 50% of the polybutene is derived from isobutylene. The polyalkenes are prepared by conventional procedures.

In one embodiment, the hydrocarbyl groups are derived from polyalkenes having an n of at least 1300, or 1500, or 1600 up to 5000, or to 3000, or to 2500, or to 2000, or to 1800, and the Mw/Mn is from 1.5 or 1.8, or 2, or to 2.5 to 3.6, or to 3.2. In some embodiments the polyalkene is polyisobutylene with a molecular weight of 800 to 1200.

In another embodiment, the substituted hydrocarbon and/or succinic acylating agents are prepared by reacting the above described polyalkene with an excess of maleic anhydride to provide substituted succinic acylating agents wherein the number of succinic groups for each equivalent weight of substituent group is at least 1.3, or to 1.5, or to 1.7, or to 1.8. The maximum number generally will not exceed 4.5, or to 2.5, or to 2.1, or to 2.0. The polyalkene here may be any of those described above. In another embodiment, the hydrocarbon and/or hydrocarbyl group contains an average from 8, or 10, or 12 up to 40, or to 30, or to 24, or to 20 carbon atoms. In one embodiment, the hydrocarbyl group contains an average from 16 to 18 carbon atoms.

The olefin, olefin oligomer, or polyalkene may be reacted with the carboxylic reagent such that there is at least one mole of carboxylic reagent for each mole of olefin, olefin oligomer, or polyalkene that reacts.

Examples of patents describing various procedures for preparing useful acylating agents include U.S. Pat. Nos. 3,172,892; 3,215,707; 3,219,666; 3,231,587; 3,912,764; 4,110,349; and 4,234,435.

In some embodiments the substituted hydrocarbon additives and/or hydrocarbyl substituted succinic acylating agents contain di-acid functionality. In some embodiments the hydrocarbyl group of the hydrocarbyl substituted succinic acylating agent is derived from polyisobutylene and the di-acid functionality of the agent is derived from carboxylic acid groups, such as hydrocarbyl substituted succinic acid. In some embodiments the hydrocarbyl substituted acylating agent comprises one or more hydrocarbyl substituted succinic anhydride groups. In some embodiments the hydrocarbyl substituted acylating agent comprises one or more hydrolyzed hydrocarbyl substituted succinic anhydride groups.

In some embodiments the oxygen-containing detergent is a polyisobutylene compound with a succinic anhydride or succinic acid head group. The oxygen-containing detergent can be a polyisobutylene succinic anhydride and/or a hydrolyzed version thereof. The preparation of suitable oxygen-containing detergents is described in the international patent application WO 2006/063161 A2.

By way of non-limiting example, the preparations of two oxygen-containing detergents are provided below.

EXAMPLE O-1

Glissopal™ 1000 (18.18 kg) is charged into a sealed vessel at 100° C. and stirred. The vessel is heated to 167° C. and vacuum applied. The vessel is then pressurized with a nitrogen atmosphere (1 bar) while heating to 175° C. Once the material reaches 175° C., maleic anhydride (2.32 kg) is added via a jacketed syringe pump (ISCO pump) equipped with traced lines over a period of about 9 hours. The reaction temperature is slowly raised over the course of the maleic anhydride feed from 175° C. to 225° C. at the end of the charge. The reaction is then held at 225° C. for a further 10 hours. The resulting polyisobutylene succinic anhydride (PIBSA) has a Kinematic Viscosity at 100° C. of 570 cSt (mm/s), and a total acid number (TAN) of 127 mgKOH/g.

EXAMPLE O-2

The PIBSA of Example O-1 (340 grams) is charged to a reaction vessel and mixed with Pilot™ 900 (60 grams). The contents of the vessel are stirred at 400 rpm for 1 hour and then heated to 90° C. The vessel is then charged with nitrogen to provide an inert atmosphere. Water (5.9 grams) is added to the mixture over 10 minutes. The mixture is then stirred for 2 hours. The resulting hydrolyzed PIBSA has a Total Acid Number of 163 mg/KOH and a Kinematic Viscosity at 100° C. of 500 mm/s (cSt). The product formed contains 85 wt % hydrolysed product and 15 wt % Pilot®900. The carbonyl to water ratio is 0.5:1.

When the detergent compositions of the present invention contain both a quaternary ammonium salt detergent and an oxygen-containing detergent, the weight ratio of the quaternary ammonium salt detergent to the oxygen-containing detergent can be from 1:10 to 10:1, 1:8 to 8:1, 1:1 to 8:1 or 3:1 to 7:1, where all weight ratios are on an solvent free basis. In other embodiments the weight ratio can be from 2:1 to 4:1.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The Metal-Containing Fuel Catalyst

The compositions of the present invention comprise a metal-containing fuel catalyst.

This metal-containing fuel catalyst is in the form of a colloidal dispersion, comprising: an organic phase; particles of an iron compound in its amorphous form; and at least one amphiphilic agent.

In the present description, the expression "colloidal dispersion" designates any system constituted by fine solid particles of an iron compound, with colloidal dimensions, in suspension in a liquid phase, said particles possibly also contain residual quantities of bound or adsorbed ions such as acetate or ammonium ions, for example. It should be noted that in such a dispersion, the iron can be either completely in the form of colloids or simultaneously in the form of ions and in the form of colloids.

The dispersion of the invention is a dispersion in an organic phase.

This organic phase is selected as a function of the use of the dispersion. The organic phase can be based on an apolar hydrocarbon.

Examples of suitable organic phases include aliphatic hydrocarbons such as hexane, heptane, octane or nonane, inert cycloaliphatic hydrocarbons such as cyclohexane, cyclopentane or cycloheptane, aromatic hydrocarbons such as benzene, toluene, ethylbenzene, xylenes or liquid naphthenes. ISOPAR or SOLVESSO (registered trade mark owned by EXXON) petroleum cuts, in particular SOLVESSO 100 which essentially contains a mixture of methylethyl- and trimethyl-benzene, SOLVESSO 150 which comprises a mixture of alkylbenzenes, in particular dimethylbenzene and tetramethylbenzene, and ISOPAR which essentially contains iso- and cycloparaffinic C-11 and C-12 hydrocarbons, are also suitable.

It is also possible to use chlorinated hydrocarbons as the organic phase such as chloro- or dichloro-benzene or chlorotoluene. Ethers and aliphatic and cycloaliphatic ketones such as diisopropyl ether, dibutyl ether, methylisobutylketone, diisobutylketone or mesityl oxide can be envisaged.

Clearly, the organic phase can be based on a mixture of two or more hydrocarbons of the type described above.

The particles of the dispersion of the invention are particles of an iron compound the composition of which essentially corresponds to an iron oxide and/or hydroxide and/or oxyhydroxide. The iron is generally essentially present in oxidation state 3. The particles also contain a complexing agent. The complexing agent corresponds to that which is used in the process for preparing the dispersion either as such or in the form of an iron complex.

The particles of the dispersion of the invention are based on an iron compound which is amorphous. This amorphous character can be demonstrated by X ray analysis, as the X ray diagrams obtained do not show any significant peaks.

In accordance with one characteristic of the invention, at least 85%, more particularly at least 90% and still more particularly at least 95% of the particles of the iron compound are primary particles. The term "primary particle" means a particle which is completely discrete and which is not aggregated with another or several other particles. This characteristic can be demonstrated by examining the dispersion using TEM (high resolution transmission electron microscopy).

It is also possible to use the cryo-TEM technique to determine the degree of aggregation of elementary particles. It allows transmission electron microscopic (TEM) examination of samples that are frozen in their natural medium which is either water or organic diluents such as aromatic or aliphatic solvents, for example SOLVESSO and ISOPAR, or certain alcohols such as ethanol.

Freezing is carried out on thin films about 50 nm to 100 nm in thickness, either in liquid ethane for aqueous samples or in liquid nitrogen for others.

The cryo-TEM preserves the degree of dispersion of the particles and is representative of that present in the actual medium.

This characteristic of the particles of the dispersion contributes to its stability.

Further, the particles of the iron compound in the dispersion of the invention have a fine granulometry. They have a d50 in the range 1 nm to 5 nm, more particularly in the range 3 nm to 4 nm. This notation d50 represents the particle size such that 50% of the particles present a size which is less than or equal to the size in said range.

The granulometry is determined by transmission electron microscopy (TEM) in conventional manner using a sample that has been dried on a carbon membrane supported on a copper grid.

This technique for preparing the sample is preferred as it allows better accuracy in the particle size measurement. The zones selected for the measurements are those which have a degree of dispersion similar to that observed in cryo-TEM.

The particles of the dispersion of the invention can have an isotropic morphology, in particular with a ratio L (largest dimension)/I (smallest dimension) of at most 2.

The organic colloidal dispersion of the invention comprises at least one amphiphilic agent with the organic phase. This amphiphilic agent can be a carboxylic acid which generally contains 10 to 50 carbon atoms, preferably 15 to 25 carbon atoms.

Said acid may be linear or branched. It can be selected from aryl, aliphatic or arylaliphatic acids, optionally carrying other functions provided that those functions are stable in the media in which the dispersions of the invention are to be used. Thus, for example, it is possible to use aliphatic carboxylic acids, aliphatic sulphonic acids, aliphatic phoshonic acids, alkylarylsulphonic acids and alkylarylphosphonic acids, whether natural or synthetic. Clearly, it is possible to use a mixture of acids.

Examples that can be cited include fatty acids of tall oil, soya oil, tallow, linseed oil, oleic acid, linoleic acid, stearic acid and their isomers, pelargonic acid, capric acid, lauric acid, myristic acid, dodecylbenzenesulphonic acid, 2-ethylhexanoic acid, naphthenic acid, hexoic acid, toluenesulphonic acid, toluenephosphonic acid, laurylsulphonic acid, laurylphosphonic acid, palmitylsulphonic acid and palmitylphosphonic acid.

Within the context of the present invention, the amphiphilic agent can also be selected from polyoxyethylenated alkyl ether phosphates. This means phosphates with formula:

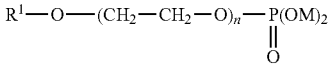

or polyoxyethylenated dialkyl phosphates with formula:

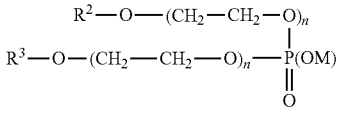

in which formulae: $R^1$, $R^2$ and $R^3$, which may be identical or different, represent a linear or branched alkyl radical, in particular containing 2 to 20 carbon atoms; a phenyl radical; an alkylaryl radical, more particularly an alkylphenyl radical, in particular with an alkyl chain containing 8 to 12 carbon atoms; or an arylalkyl radical, more particularly a phenylaryl radical; n represents the number of ethylene oxide units, which can be from 0 to 12, for example; M represents a hydrogen, sodium or potassium atom.

In particular, $R^1$ can be a hexyl, octyl, decyl, dodecyl, oleyl or nonylphenyl radical.

Examples of these types of amphiphilic compounds include sold under the trade marks LUBROPHOS® and RHODAFAC® by Rhodia and in particular the following products: RHODAFAC® RA polyoxyethylene (C8-C10) alkylether phosphates; RHODAFAC® RS710 or RS 410 polyoxyethylene tridecyl ether phosphate; RHODAFAC® PA 35 polyoxyethylene oleodecyl ether phosphate; RHODAFAC® PA17 polyoxyethylene nonylphenyl ether phosphate; RHODAFAC® RE610 polyoxyethylene (branched)nonyl ether phosphate.

Finally, the amphiphilic agent can be a polyoxyethylenated alkyl ether carboxylate with formula: $R^4—(OC_2H_4)_n—O—R^5$, in which $R^4$ is a linear or branched alkyl radical which can in particular contain 4 to 20 carbon atoms, n is a whole number which can, for example, be up to 12 and $R^5$ is a carboxylic acid residue such as $—CH_2COOH$. Examples of this type of amphiphilic compound include those sold by Kao Chemicals under the trade mark AKIPO®.

The dispersions of the invention have an iron compound concentration which can be at least 8%, more particularly at least 15% and still more particularly at least 30%, this concentration being expressed as the equivalent weight of iron III oxide with respect to the total dispersion weight. This concentration can be up to 40%.

The process for preparing the dispersions of the invention will now be described.

The first step of the process consists of reacting either an iron salt in the presence of a complexing agent or an iron complex with a base. This reaction is carried out in an aqueous medium.

Particular examples of the base can be hydroxide type products. Alkali or alkaline-earth hydroxides and ammonia can be cited. It is also possible to use secondary, tertiary or quaternary amines. However, amines and ammonia may be preferred provided that they reduce the risk of pollution by alkali or alkaline-earth cations. Urea can also be mentioned.

Any water-soluble salt can be used as the iron salt. More particularly, ferric nitrate can be mentioned.

In accordance with a specific characteristic of the process of the invention, the iron salt is reacted with the base in the presence of an iron complexing agent.

The iron complexing agents are selected from hydrosoluble carboxylic acids with a complexing constant K such that the pK is at least 3.

For the reaction: $Fe^{3+}+xL^- \square FeL_x^{3-x}$ in which L designates the complexing agent, the constant K is defined as follows: $K=FeLx^{3-x}/[Fe^{3+}].[L^-]^x$ and $pK=\log(1/K)$.

Acids having the above characteristics include aliphatic carboxylic acids such as formic acid or acetic acid. Acid-alcohols or polyacid-alcohols are also suitable. Examples of acid-alcohols that can be cited are glycolic acid and lactic acid. Polyacid-alcohols that can be mentioned are malic acid, tartaric acid and citric acid.

Other suitable acids include amino acids such as lysine, alanine, serine, glycine, aspartic acid or arginine. It is also possible to mention ethylene-diamine-tetraacetic acid or nitrilo-triacetic acid or N,N-diacetic glutamic acid with formula $(HCOO^-)CH_2CH_2—CH(COOH)N(CH_2COO—H)_2$ or its sodium salt $(NaCOO—)CH_2CH_2—CH(COONa)N(CH2COO—Na)_2$.

Other suitable complexing agents that can be used are polyacrylic acids and their salts such as sodium polyacrylate, and more particularly those the mass average molecular mass of which is in the range 2000 to 5000.

Finally, it should be noted that a plurality of complexing agents can be used conjointly.

As indicated above, the reaction with the base can also be carried out with an iron complex. In this case, the iron complex used is a product resulting from complexing iron with a complexing agent of the type described above. This product can be obtained by reacting an iron salt with said complexing agent.

The quantity of complexing agent used, expressed as the mole ratio of complexing agent/iron, is preferably in the range 0.5 to 4, more particularly in the range 0.5 to 1.5 and still more particularly in the range 0.8 to 1.2.

The reaction between the iron salt and the base is carried out under conditions such that the pH of the reaction mixture which is formed is at most 8. More particularly, this pH can be at most 7.5 and it can in particular be in the range 6.5 to 7.5.

The aqueous mixture and basic medium are brought into contact by introducing a solution of the iron salt into a solution containing the base. It is possible to carry out contact continuously, the pH condition being satisfied by adjusting the respective flow rates of the solution of iron salt and of the solution containing the base.

In a preferred implementation of the invention, it is possible to operate under conditions such that during the reaction between the iron salt and the base, the pH of the reaction medium formed is kept constant. The terms "pH is kept constant"; means a pH variation of ±0.2 pH units with respect to the fixed value. Such conditions can be achieved by adding an additional quantity of base to the reaction mixture formed during the reaction between the iron salt and the base, for example when introducing the iron salt solution to the solution of the base.

The reaction is normally carried out at ambient temperature. This reaction can advantageously be carried out in an atmosphere of air or nitrogen or a nitrogen-air mixture.

At the end of the reaction, a precipitate is obtained. Optionally, the precipitate can be matured by keeping it in the reaction medium for a certain period, for example several hours.

The precipitate can be separated from the reaction medium using any known means. The precipitate can be washed.

Preferably, the precipitate does not undergo a drying or freeze drying step or any operation of that type.

The precipitate can optionally be taken up in aqueous suspension.

However, it should be noted that it is entirely possible not to separate the precipitate from the reaction medium in which it has been produced To obtain a colloidal dispersion in an organic phase, either the separated precipitate or the aqueous suspension obtained above after separating the precipitate from the reaction medium, or the precipitate in suspension in its reaction medium is brought into contact with the organic phase in which the colloidal dispersion is to be produced. This organic phase is of the type described above.

This contact is brought about in the presence of said amphiphilic agent. The quantity of this amphiphilic agent to be incorporated can be defined by the mole ratio r where r is the number of moles of amphiphilic agent/number of moles of iron element.

This mole ratio can be in the range 0.2 to 1, preferably in the range 0.4 to 0.8.

The quantity of organic phase to be incorporated is adjusted to obtain a concentration of oxide as mentioned above.

At this stage, it may be advantageous to add to the organic phase a promoter agent the function of which is to accelerate transfer of particles of iron compound from the aqueous phase to the organic phase, if starting from a suspension of the precipitate, and to improve the stability of the organic colloidal dispersions obtained.

The promoter agent may be a compound with an alcohol function, more particularly linear or branched aliphatic alcohols containing 6 to 12 carbon atoms. Specific examples that can be mentioned are 2-ethylhexanol, decanol, dodecanol and mixtures thereof.

The proportion of said agent is not critical and can vary widely. However, a proportion in the range 2% to 15% by weight with respect to the whole dispersion is generally suitable.

The order in which the different elements of the dispersion are introduced is unimportant. The aqueous suspension, amphiphilic agent, organic phase and optional promoter agent may be mixed simultaneously. It is also possible to pre-mix the amphiphilic agent, organic phase and optional promoter agent.

Contact between the aqueous suspension or the precipitate and the organic phase can be made in a reactor which is in an atmosphere of air, nitrogen or an air-nitrogen mixture.

While contact between the aqueous suspension and the organic phase may be made at ambient temperature, about 20° C., it is preferable to operate at a temperature that is in the range from 60° C. to 150° C., advantageously between 80° C. and 140° C.

In certain cases, because of the volatility of the organic phase, its vapours may be condensed by cooling to a temperature below its boiling point.

The resulting reaction mixture (mixture of aqueous suspension, amphiphilic agent, organic phase and optional promoter agent) is stirred for the whole heating period, which can vary.

When heating is stopped, two phases are observed: an organic phase containing the colloidal dispersion, and a residual aqueous phase.

The organic phase and aqueous phase are then separated using conventional separation techniques such as decantation and/or centrifugation resulting in a colloidal dispersion which has the characteristics mentioned above.

The composition of the invention, that is the composition comprising (a) the detergent composition and (b) the active metal containing compound in the form of a colloidal dispersion, is obtained by mixing the detergent composition and the colloidal dispersion using any conventional techniques, said mixing being carried out generally under stirring and at ambient temperature (20 to 30° C.).

The weight ratio of the colloidal dispersion/detergent composition can vary widely. It is more particularly between 10/90 and 90/10, in some embodiments between 20/80 and 80/20 and in still further embodiments between 40/60 and 60/40.

In the composition of the invention, that is the composition comprising (a) the detergent composition and (b) the colloidal dispersion of iron, the iron concentration can be comprised between 0.05% and 40%, more particularly between 1% and 20%, this concentration being expressed as the equivalent weight of iron III oxide with respect to the total composition weight.

The Fuel

The fuel compositions of the present invention comprise the fuel additives described above and a liquid fuel, and is useful in fueling an internal combustion engine. A fuel may also be a component of additive compositions comprising the fuel additives described above.

In some embodiments, the fuels suitable for use in the present invention include any commercially available fuels, and in some embodiments any commercially available diesel fuels and/or biofuels.

The present invention includes fuel compositions and fuel additive concentrate compositions which may contain fuel. The description that follows of the types of fuels suitable for use in the present invention refer to the fuel that may be present in the additive containing compositions of the present invention as well as the fuel and/or fuel additive compositions to which the additive containing compositions may be added.

Fuels suitable for use in the present invention are not overly limited. Generally, suitable fuels are normally liquid at ambient conditions e.g., room temperature (20 to 30° C.). The liquid fuel can be a hydrocarbon fuel, a non-hydrocarbon fuel, or a mixture thereof.

The hydrocarbon fuel can be a petroleum distillate, including a gasoline as defined by ASTM specification D4814, or a diesel fuel, as defined by ASTM specification D975 or European specification EN590. In one embodiment the liquid fuel is a gasoline, and in another embodiment the liquid fuel is a non-leaded gasoline. In another embodiment the liquid fuel is a diesel fuel. The hydrocarbon fuel can be a hydrocarbon prepared by a gas to liquid process to include for example hydrocarbons prepared by a process such as the Fischer-Tropsch process. In some embodiments, the fuel used in the present invention is a diesel fuel, a biodiesel fuel, or combinations thereof.

The non-hydrocarbon fuel can be an oxygen containing composition, often referred to as an oxygenate, which includes an alcohol, an ether, a ketone, an ester of a carboxylic acid, a nitroalkane, or a mixture thereof. The non-hydrocarbon fuel can include for example methanol, ethanol, methyl t-butyl ether, methyl ethyl ketone, transesterified oils and/or fats from plants and animals such as rapeseed methyl ester and soybean methyl ester, and nitromethane.

Mixtures of hydrocarbon and non-hydrocarbon fuels can include, for example, gasoline and methanol and/or ethanol, diesel fuel and ethanol, and diesel fuel and a transesterified plant oil such as rapeseed methyl ester and other bio-derived fuels. In one embodiment the liquid fuel is an emulsion of water in a hydrocarbon fuel, a non-hydrocarbon fuel, or a mixture thereof. In several embodiments of this invention the liquid fuel can have a sulphur content on a weight basis that is 5000 ppm or less, 1000 ppm or less, 300 ppm or less, 200 ppm or less, 30 ppm or less, or 10 ppm or less.

The liquid fuel of the invention is present in a fuel composition in a major amount that is generally greater than 95% by weight, and in other embodiments is present at greater than 97% by weight, greater than 99.5% by weight, or greater than 99.9% by weight.

Miscellaneous

The compositions of the present invention optionally comprise one or more additional performance additives, solvents or diluents.

The additional performance additives can include: an antioxidant such as a hindered phenol or derivative thereof and/or a diarylamine or derivative thereof; a corrosion inhibitor; and/or a detergent/dispersant additive, other than the fuel additive of the present invention, such as a polyetheramine or nitrogen containing detergent, including but not limited to PIB amine detergents/dispersants and succinimide detergents/dispersants.

The additional performance additives may also include: a cold flow improver such as an esterified copolymer of maleic anhydride and styrene and/or a copolymer of ethylene and vinyl acetate; a foam inhibitor and/or antifoam agent such as a silicone fluid; a demulsifier such as a polyalkoxylated alcohol; a lubricity agent such as a fatty carboxylic acid; a metal deactivator such as an aromatic triazole or derivative thereof, including but not limited to benzotriazole; and/or a valve seat recession additive such as an alkali metal sulfosuccinate salt.

The total combined amount of the additional performance additive compounds present on an solvent/oil free basis may range from 0 or 0.01 wt % to 65, 50, or even 25 wt % or from 0.01 wt % to 20 wt % of the composition. Although one or more of the other performance additives may be present, it is common for the other performance additives to be present in different amounts relative to each other.

Industrial Application

In one embodiment the composition of the invention comprising (a) the detergent composition and (b) the active metal compound is combined with the fuel by direct addition and the fuel is used to operate an engine equipped with an exhaust system particulate trap. The fuel containing the composition of the invention may be contained in a fuel tank, transmitted to the engine where it is burned, and the metal compound reduces the ignition temperature of particles collected in the DPF. In another embodiment, the foregoing operational procedure is used except that the composition of the invention is maintained on board the apparatus being powered by the engine (e.g., automobile, bus, truck, etc.) in a separate composition dispenser apart from the fuel. In such embodiments the composition is combined or blended with the fuel during the operation of the engine. Other techniques comprise adding the composition of the invention to the fuel and/or fuel tank at fuel depots prior to filling the tank of the powered vehicle.

The composition of the invention may be added to the fuel in a quantity such as the amount of iron is comprised between 1 ppm and 50 ppm, more particularly between 2 ppm and 20 ppm, this quantity being expressed by weight of iron element with respect to the fuel weight.

Where the invention is used as a liquid fuel composition for an internal combustion engine suitable internal combustion engines include spark ignition and compression ignition engines; 2-stroke or 4-stroke cycles; liquid fuel supplied via direct injection, indirect injection, port injection and carburetor; common rail and unit injector systems; light (e.g. passenger car) and heavy duty (e.g. commercial truck) engines; and engines fuelled with hydrocarbon and non-hydrocarbon fuels and mixtures thereof. The engines may be part of integrated emissions systems incorporating such elements as; EGR systems; aftertreatment including three-way catalyst, oxidation catalyst, NOx absorbers and catalysts, catalyzed and non-catalyzed particulate traps; variable valve timing; and injection timing and rate shaping.

It is known that some of the materials described above may interact in the final formulation, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which sets forth particularly advantageous embodiments. While the examples are provided to illustrate the present invention, they are not intended to limit it.

Example 1

The Fe Colloidal Dispersion

The dispersion is prepared as follows: Firstly, a solution of iron acetate was prepared. 412.2 g of 98% $Fe(NO_3)\ 5H_2O$ was introduced into a beaker and demineralized water was added to a volume of 2 liters. The solution was 0.5 M in Fe. 650 ml of 10% ammonia was added dropwise, with stirring and at ambient temperature to produce a pH of 7. It was centrifuged for 10 min at 4500 rpm. The mother liquor was eliminated. It was taken up in suspension in water to a total volume of 2650 cm3. It was stirred for 10 min. It was centrifuged for 10 min at 4500 rpm, then taken up into suspension in demineralized water to 2650 cm3. It was stirred for 30 minutes. 206 ml of concentrated acetic acid was then added. It was left overnight with stirring. The solution was clear. A solid was then precipitated in a continuous apparatus comprising: a one liter reactor provided with a paddle agitator and an initial stock constituted by 500 cm3 of demineralized water. This reaction volume was kept constant by overflow; two supply flasks containing the iron acetate solution described above and a 10 M ammonium solution. The iron acetate solution and the 10 M ammonia solution were added. The flow rates of the two solutions were fixed so that the pH was kept constant at 8. The precipitate obtained was separated from the mother liquor by centrifuging at 4500 rpm for 10 min. 95.5 g of recovered hydrate, 21.5% dry extract (i.e. 20.0 g equivalent of Fe2O3 or 0.25 mole of Fe), was re-dispersed in a solution containing 31.5 g of isostearic acid and 85.8 g of ISOPAR L. The suspension was introduced into a jacketed reactor provided with a thermostatted bath and a stirrer. The reaction assembly was heated to 90° C. for 5 h30. After cooling, it was transferred into a test tube. Demixing was observed and an aqueous phase and an organic phase were recovered.

The iron content of the organic phase, measured by X-ray fluorescence analysis, is 10% weight metal. Completely discrete particles about 3 to 5 nm in diameter were observed by TEM cryo-microscopy. X ray analysis of the dispersion showed that the particles were amorphous. The colloidal dispersion of this example is called, here below, additive A.

Example 2

The Detergent Composition

Example 2A

A detergent composition is prepared, consisting of a succinimide quaternary ammonium salt derived from dimethylaminopropylamine succinimide, 2-ethylhexyl alcohol and acetic acid, and is quaternized by propylene oxide and is prepared by a method substantially similar to that described in Example Q-1 above.

Example 2B

A detergent composition is prepared by mixing 50 pbw of the succinimide quaternary ammonium salt of Example 2A with 18 pbw of an oxygen-containing detergent, where all pbw values are on a solvent free basis. The mixing of the components is carried out at ambient conditions. The oxygen-containing detergent is a polyisobutylene succinic anhydride derived from 1000 number average molecular weight high vinylidene polyisobutylene and maleic anhydride and is prepared by a method substantially similar to that described in Example O-1.

Example 2C

A detergent composition is prepared according to the procedures of Example 2B except that 35 pbw of the succinimide quaternary ammonium salt with 9 pbw of the oxygen-containing detergent, where all pbw values are on a solvent free basis.

Example 2D

A detergent composition is prepared according to the procedures of Example 2B except that the oxygen-containing detergent is hydrolyzed by reacting it with water, forming a polyisobutylene succinic acid prepared by a method substantially similar to that described in Example O-2.

Example 2E

A detergent composition is prepared according to the procedures of Example 2A except that the succinimide quaternary ammonium salt is derived from dimethylaminopropylamine succinimide and dimethyl sulphate and is prepared by a method substantially similar to that described in Example Q-2 except that more solvent is present resulting in a mixture having an actives level of 65% by weight in a petroleum naphtha solvent.

Example 2F

A detergent composition is prepared according to the procedures of Example 2C except that the oxygen-containing detergent is hydrolyzed by reacting it with water, forming a polyisobutylene succinic acid prepared by a method substantially similar to that described in Example O-2.

Example 3

Synthesis of Additives Containing Fe FBC and Detergent

Two additives consisting of a mixture of the colloidal dispersion A and the detergents of examples 2A and 2F are prepared by mixing at room temperature each liquid in controlled proportions.

Thus, 24.68 grams of the detergent composition of Example 2A are added with 30.96 grams of the colloidal dispersion of additive A from Example 1 and are maintained under stirring at 120 rpm. Stirring of the 2 components is maintained for 30 minutes and the quality of the mixture is controlled by measuring the content of iron at the top and at the bottom of the obtained liquid. At the end of the 30 minutes of stirring, the content of iron at the top and at the bottom of the liquid is identical. This additive, called B thereafter, contains 5.56% weight of metal iron coming from dispersion A and contains succinimide quaternary ammonium salt of Example 2A.

The other additive is prepared in the same way by mixing 30.96 grams of colloidal dispersion A with 41.04 grams of a detergent component containing 22.12 grams of the neat detergent composition of Example 2F and 18.92 grams of solvent, said solvent being a mixture of ISOPAR and 2-ethylhexanol. This additive, called C thereafter, contains 4.3% weight of metal iron coming from dispersion A and contains the detergent composition of Example 2F, which comprises a mixture of succinimide quaternary ammonium salt and an oxygen-containing detergent

Example 4

Fe Stability in Diesel Fuels with or without Biofuels

Description of the fuels used: Three fuels were used for this testing:

- a diesel fuel marketed by the British Petroleum (BP) company under the trade name of BP Ultimate;
- a test diesel fuel B5 type containing approximately 6% by volume of biofuel; and
- a test diesel fuel B10 type containing approximately 11% of biofuel.

Table 1 gives the main features of the B5 and B10 fuels.

TABLE 1

| | | FUEL | |
|---|---|---|---|
| | | B5 | B10 |
| COMPOSITION | | | |
| Total Aromatics | % mass | 18 | 24 |
| Poly-aromatics | % mass | 4 | 4 |
| COMPLEMENTARY DATA | | | |
| Sulphur | mg/kg | <10 | 5 |
| Conradson Carbon on 10% vol residue | % weight/% mass | <0.1 | <0.2 |
| Acidic index | mg KOH/g | <0.01 | 0.05 |
| Copper content | mg/kg | <0.1 | 0 |
| Oxidation stability (rancimat) | Hours | <20 | 22 |
| Zinc content | mg/kg | <0.01 | 0 |

Table 2 indicates that these three diesel fuels contain between 6.1 and 10.8% by volume of biofuel in the form of methyl esters of fatty acids (measuring according to EN14078 standard, based on a Infra-red spectroscopy measuring of the content of methyl esters of fatty-acid (EMAG)).

TABLE 2

EMAG content in the fuels (measuring according to EN14078 standard)

| Fuel | % v/v EMAG |
|---|---|
| BP Ultimate | 7.0 |
| B5 | 6.1 |
| B10 | 10.8 |

Procedure of the stability test of the iron colloidal dispersion in the fuels: For each fuel, a precise quantity of the additive A, B or C is added to 250 ml of fuel.

Additive A: 14.8 mg
Additive B: 26.6 mg
Additive C: 34.4 mg

Thus, there is obtained, after homogenisation, 9 fuels which are additized with the iron colloidal dispersion A with a total value of 7 ppm weight of Fe and, possibly, with a detergent in the weight proportions of the additive used for the additives B and C.

The test consists in heating the additized fuel at 70° C. during several days and in following the evolution of the iron content in this fuel in terms of the heating time. A volume of 20 ml of fuel is taken in the upper part of the fuel, filtered on a 0.2 μm filter, then the iron content of the filtrate is measured by X-ray fluorescence analysis. The colloidal dispersion is considered as stable as long as the content of iron in the fuel is not decreased of more than 10%.

TABLE 3 duration of stability of the additives in the fuels (in days)

| | With additive A | With additive B | With additive C |
|---|---|---|---|
| BP Ultimate | 18 days | >50 days(*) | >50 days(*) |
| B5 | 1 day | 22 days | 44 days |
| B10 | 1 day | 11 days | 29 days |

(*)Test stopped at 50 days meaning that stability is higher than 50 days.

It is noted that whatever the diesel fuel, the duration of stability of additive A, which contains no detergent, is shorter than that of the two other additives B and C containing succinimide quaternary ammonium salt detergent. When the oxygen-containing detergent is present in combination with the succinimide quaternary ammonium salt detergent (additive C) stability is increased still further.

Example 5

Oxidation Resistance of the Fuel in the Presence of Additive

The oxidation resistance of the three diesel fuels from example 4 was measured with and without additized of each of the 3 additives A, B and C.

The test consists of making an oxygen bubble in the fuel, maintained at a constant temperature, and then measuring its degradation owing to the oxidation of the fuel, which is quantified by the evolution of its acidity.

Ageing is carried out according to the EN ISO 12205 standard (Oil products—Determination of stability to oxidation of the average oil distillates (1996)). Briefly, this method consists in making air bubble at 115° C.±1° C. during 16 hours with a flow of 6 L/h in 350 ml of fuel, with or without additive, filtered beforehand on a glass fibre filter of 0.7 μm porosity (Millipore, Whatman). The fuel is introduced into an oxidation cell, the other conditions of the ageing test are the same ones as those described in the EN ISO 12205 standard.

After ageing and cooling at room temperature, the fuel, with or without additive, is filtered through two successive glass fibre filters of 0.7 μm porosity. The acidity of the aged fuel is then immediately measured by potentiometric titration according to the ISO 6619 standard (Oil products and lubricants—Index of neutralization—Potentiometric Titration Method (1988)) and is compared with that of the not aged fuel: acidity is expressed in mg of KOH/g of fuel and the evolution of acidity is expressed according to the difference of acidity or ΔTAN between the aged fuel and the non aged fuel.

ΔTAN is calculated according to the following formula: ΔTAN=ANa−ANb, wherein ANa is the acidity of the aged filtered fuel and ANb is the acidity of the filtered fuel before oxidation.

Table 4 shows that the degradation of the fuel, measured by the increase in its acidity as shown by the reported ΔTAN values, is reduced when additives B and C, containing the succinimide quaternary ammonium salt detergent and the optional oxygen-containing detergent, are used. The joint presence of a succinimide quaternary ammonium salt detergent and the oxygen-containing detergent (additive C) makes it possible to reduce still further the degradation of the fuel by oxidation, particularly for the fuel richest in biofuel (B10).

TABLE 4

ΔTAN of the different fuels with or without additive

| | Fuel without additive | Fuel + additive A | Fuel + additive B | Fuel + additive C |
|---|---|---|---|---|
| BP Ultimate | 0.01 | 0.06 | 0.02 | 0.01 |
| B5 | 0.02 | 0.60 | — | 0.17 |
| B10 | 0.27 | 1.10 | 0.77 | 0.49 |

Example 6

Injector Fouling Resistance Engine Testing

Several samples have been prepared and tested in a DW10 sixteen hour engine test in order to evaluate the samples ability to reduce injector fouling. This DW10 engine test is a screen test using the Coordinating European Council's (CEC) F-98-08 DW10 testing protocol, which utilizes a Peugeot DW-10 engine. This is a light duty direct injection, common rail engine test that measures engine power loss, which relates to fuel detergent additive efficiency, where lower power loss values indicate better detergent performance. The test engine is representative of new engines coming into the market and the test method is known in the field.

The test reports a delta power value indicating power loss compared to the start of the test. This change in power is indicative of injector fouling as fouled injectors leads to power loss in an engine. The samples tested and the results obtained are summarized in the table below. The treat rates of the detergents in Table 5 are on a solvent free basis.

TABLE 5

DW10 Test Results

| Sample ID | Base Fuel | Fe From Fuel Catalyst[1] | Quat Salt Detergent[2,3] | Oxygen Detergent[4] | DW10 Delta Power |
|---|---|---|---|---|---|
| A | CEC DF-79- | none | none | none | −1.77% |
| B[2] | 07 Diesel | none | 50 ppm | 18 ppm | −0.52% |
| C[4] | Fuel with 10 wt % SME[5] added | none | none | 68 ppm | −1.67% |
| D | Commercial | none | none | none | 0.00% |
| E | Diesel Fuel[6] | 7 ppm | none | none | −6.34% |
| F | Commercial | none | none | none | +1.10% |
| G[2] | B5 Biofuel[7] | 7 ppm | 50 ppm | none | −1.40% |
| H[2] | | 7 ppm | 35 ppm | 9 ppm | +0.37% |
| I[3] | | 7 ppm | 51 ppm | none | −1.94% |
| J | CEC RF-93- | none | none | none | −4.2% |
| K | T-95 Diesel | 4 ppm | none | none | −9.5% |

TABLE 5-continued

DW10 Test Results

| Sample ID | Base Fuel | Fe From Fuel Catalyst[1] | Quat Salt Detergent[2,3] | Oxygen Detergent[4] | DW10 Delta Power |
|---|---|---|---|---|---|
| L[2] | Fuel with 1 mg/kg Zn[8] added | 4 ppm | 22 ppm | 7 ppm | −4.1% |

[1]The Iron is delivered to the fuel via a fuel catalyst which is a stabilized dispersion of Iron as described in Example 1 above.
[2]The quaternary salt detergent used in Samples B, G, H, and L is the detergent composition of Example 2A above.
[3]The quaternary ammonium salt detergent used in Sample I is the detergent composition of Example 2E above.
[4]The oxygen-containing detergent used in this testing is the oxygen-containing detergent described in Example 2F above.
[5]SME is soybean methyl ester. The CEC DF-79-04 fuel was top treated with SME to a level of 10 wt %.
[6]The commercial diesel fuel used is a ULSD fuel that meets the EN 590 specifications.
[7]The Commercial B5 Biofuel is from the same source, but different lot, as the B5 fuel described in detail in Table 1 above and has substantially similar properties.
[8]The CEC RF-93-T-95 fuel was top treated with zinc to a level of 1 mg Zn per kg of fuel.

The results show that the present invention provides reduced injector fouling. Considering Samples A, B and C, the results show that, separate from the fuel catalyst, the oxygen-containing detergent by itself (sample C) does not significantly reduce injector fouling while the combination of the quaternary salt detergent and oxygen-containing detergent (sample B) does. Samples D and E demonstrate that the fuel catalyst by itself causes significant power loss. Samples F, G, H and I show that the combination of quaternary salt detergent, oxygen-containing detergent and fuel catalyst provide significantly improved injector fouling control. Further, the results for Samples A thru I are all roughly comparable despite the relatively small differences in the fuels used. The poor results for Samples E and K are easily expected to repeat to all of the fuels tested such that a comparison of Samples E to G, H and I indicate that the combination of quaternary salt detergent and fuel catalyst (Samples G and I) provides a significant reduction in injector fouling compared to fuel containing the fuel catalyst alone (Sample E) and a combination of quaternary salt detergent, oxygen-containing detergent and fuel catalyst (Sample H) provides even greater benefit. Samples J, K and L further show that the fuel containing the fuel catalyst alone (Sample K) provides a poor result while the combination of quaternary salt detergent, oxygen-containing detergent and fuel catalyst (Sample L) brings injector fouling performance in line with the baseline fuel. This improved performance obtained by the combination of the fuel catalyst, the quaternary ammonium salt, and the optional oxygen detergent is a surprising result.

Example 7

Filter Regeneration Engine Testing

The performance of additives A and C, as defined in Example 3 above, with respect to the regeneration of a particle filter was evaluated on driving bench by using a DW12TED14 engine marketed by PCM company (4 cylinders, turbo with air cooling, 2.2 Liters, Power 97.5 kw). The exhaust line used is a commercial line equipped with an oxidation catalyst containing Pt followed by a silicon carbide particle filter (4.1 L, 5.66×10 inches). The fuel used for these tests is a commercial fuel meeting the EN590 standard, containing 3 ppm sulphur and 5% of biofuel.

For these tests, the fuel is additized with additive A (colloidal suspension containing iron alone) or with additive C (the colloidal suspension containing iron and the two detergents: ammonium salt detergent and oxygen containing detergent). In both cases the content of additive is adjusted so that the content of iron in the fuel amounts to 7 ppm weight of iron.

The test consists of loading the particle filter under conditions identical for each test fuel, additized and non-additized. The loading is accomplished by operating the engine at a speed of 3000 rpm and a couple of 30 Nm over 10 hours. The temperature upstream of the filter during this phase is of about 200° C. The emissions of particles by this engine under these conditions are of 2.0 g/h (measurement after the oxidation catalyst with a non additivated fuel).

Once loaded, the filter is removed and weighed in order to control for the mass of particles accumulated during the loading phase. The filter is then refitted on the driving bench and heated while being maintained 30 minutes under the engine conditions of the loading point (3000 rpm and 30 Nm).

The engine conditions are then modified (couple 30 Nm and 1650 rpm) and a fuel post injection is ordered by the electronic control unit of the engine (ECU) in order to increase the temperature upstream the particle filter up to 450° C. and to start the regeneration of the filter. These conditions are maintained for 45 minutes.

The efficiency of the regeneration of the filter is measured by two criteria: evolution of the pressure drop on the particle filter and evolution of the mass of the filter during regeneration. For comparison, a test was also carried out by using the fuel without additive A or C.

The results obtained are summarized in the following table.

TABLE 6

Filter regeneration test

| | Additive Present in Test Fuel | | | | |
|---|---|---|---|---|---|
| | none | A | A | C | C |
| Iron content in the fuel (ppm weight) | 0 | 5 | 7 | 5 | 7 |
| Amount of particles in the filter after loading (g) | 27.1 | 24.3 | 25.1 | 28.6 | 29.0 |
| Quantity of $Fe_2O_3$ resulting from the additive in the filter (g)(*) | 0 | 0.20 | 0.28 | 0.20 | 0.28 |
| Particles burnt during the regeneration (g) | 3.2 | 21.5 | 23.1 | 25.6 | 25.9 |
| Particles burnt during the regeneration (%) | 12 | 88 | 92 | 90 | 89 |
| Pressure drop of the filter before loading (mbar) | 21 | 25 | 25 | 21 | 23 |
| Pressure drop of the filter after loading (mbar) | 74 | 70 | 73 | 76 | 77 |
| Pressure drop of the filter after 5 minutes of regeneration (mbar) | 72 | 30 | 25 | 26 | 25 |
| Pressure drop of the filter after 45 minutes of regeneration (mbar) | 59 | 21 | 20 | 21 | 21 |

(*) calculated in considering a loading of the filter during 10 h with a fuel consumption of 4 kg/h Without any catalytic additive, the regeneration of the filter at 450° C. is very limited: 12% of the particles are burnt in 45 minutes, which is confirmed by the pressure drop of the filter, which does not go back down to the pre-loading level (59 mbar against 21). In addition, the regeneration is very slow since the pressure drop is reduced by only 2 mbar after 5 minutes at 450° C.

On the other hand, when additive A or C is present in the fuel, the particles are burnt in an amount of about 90% after 45 minutes at 450° C. The pressure drop also returns to the initial pre-loading value once the regeneration is completed. In addition, the reduction of the pressure drop after 5 minutes is an important result as it gives an indication of the regeneration kinetics (the rate of the regeneration reactions), with faster kinetics being preferred. Here the results show a significant amount of regeneration after 5 minutes for the fuels containing additives A or C, indicating favourably fast kinetics.

Moreover, the amount of additive present in the fuel can be reduced for example to the equivalent of 5 ppm iron without significant incidence on the duration or the extent of regeneration. Lastly, the iron containing additive is also efficient with respect to soot combustion when it is introduced in the presence of the detergent (additive C).

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values are percents by weight and all ppm values are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

The invention claimed is:

1. A composition comprising:

(A) a detergent composition comprising (1) a quaternary ammonium salt detergent; and (B) an active metal compound in the form of a colloidal dispersion, comprising: an organic phase; particles of an iron compound in its amorphous form; and at least one amphiphilic agent; wherein the particles of the iron compound have a d50 of 1 nm to 5 nm.

2. The composition of claim 1, wherein the detergent composition (A) further comprises (2) an oxygen-containing detergent.

3. The composition of claim 1, wherein the quaternary ammonium salt detergent comprises the reaction product of:

(i) at least one compound comprising:

(a) a condensation product of a hydrocarbyl-substituted acylating agent and a compound having an oxygen or nitrogen atom that can condense the acylating agent wherein the condensation product has at least one tertiary amino group;

(b) a polyalkene-substituted amine having at least one tertiary amino group; or (c) a Mannich reaction product having at least one tertiary amino group, wherein the Mannich reaction product is derived from a hydrocarbyl-substituted phenol, an aldehyde, and an amine; and (ii) a quaternizing agent suitable for converting the tertiary amino group of compound (i) to a quaternary nitrogen.

4. The composition of claim 1, wherein the quaternary ammonium salt detergent comprises the reaction product of:

(i) a reaction of a hydrocarbyl-substituted acylating agent and a compound having an oxygen or nitrogen atom that can condense with said acylating agent and further having at least one tertiary amino group; and (ii) a quaternizing agent comprising a dialkyl sulfate, a benzyl halide, a hydrocarbyl substituted carbonate, a hydrocarbyi epoxide optionally in combination with an acid, or a mixture thereof.

5. The composition of claim 4, wherein the hydrocarbyl-substituted acylating agent is polyisobutylene succinic anhydride and the compound having an oxygen or nitrogen atom that can condense with said acylating agent is a compound selected from the group consisting of dimethylarninopropylamine, N-methyl-1,3-diaminopropane, N,N-dimethyl-aminopropylarnine, N,N-diethyl-aminopropylamine, N,N-dimethyl-arninoethylamine, diethylenetriamine, dipropylenetriamine, dibutylenetriamine, triethylenetetraamine, tetraethylenepentaamine, pentaethyienehexaamine, hexamethylenetetramine, and bis(hexamethylene) triamine.

6. The composition of claim 2, wherein the oxygen-containing detergent is a polyisobutylene compound with a succinic anhydride or succinic acid head group.

7. The composition of claim 1, wherein at least 85% of the iron compound particles of (B), the colloidal dispersion, are primary particles.

8. The composition of claim 1, wherein the organic phase of (B), the colloidal dispersion, is based on an apolar hydrocarbon.

9. The composition of claim 1, wherein the amphiphilic agent of (B), the colloidal dispersion, is a carboxylic acid containing 10 to 50 carbon atoms.

10. The composition of claim 1, further comprising at least one member selected from the group consisting of a metal deactivator, a detergent/dispersant additive other than component (A)(1) or (A)(2), an antioxidant, a corrosion inhibitor, a foam inhibitor, a demulsifier, a cold flow improver, a lubricity agent, a valve seat recession additive and combinations thereof.

11. A method of operating an internal combustion engine, the method comprising:

A. supplying to said engine:

i. a fuel which is liquid at room temperature; and ii. a composition comprising:

(A) a detergent composition comprising (1) a quaternary ammonium salt detergent; and (B) an active metal compound in the form of a colloidal dispersion, comprising: an organic phase; particles of an iron compound in its amorphous form; and at least one amphiphilic agent; wherein the particles of the iron compound have a d50 of 1 nm to 5 nm.

12. The method of claim 11, wherein the detergent composition (A), further comprises (2) an oxygen-containing detergent.

13. The method of claim 11, wherein at least 85% of the iron compound particles of (B), the colloidal dispersion, are primary particles.

14. A fuel composition which is a liquid at room temperature, the fuel composifion comprising:

(A) a detergent composition comprising (1) a quaternary ammonium salt detergent; and (B) a active metal containing compound which is in the form of a colloidal dispersion, comprising: an organic phase; particles of an iron compound in its amorphous form; and at least one amphiphilic agent; wherein the particles of the iron compound have a d50 of 1 nm to 5 nm.

15. The fuel composition of claim 14, wherein (A), the detergent composition, further comprises (2) an oxygen-containing detergent.

16. The method of claim 11, wherein the iron compound particles of (B) present a d50 of 3 nm to 4 nm.

* * * * *